US005549033A

United States Patent [19]

Manini

[11] Patent Number: 5,549,033

[45] Date of Patent: Aug. 27, 1996

[54] HYDRAULIC GATE MOVEMENT DEVICE COMPRISING SEPARATE SUPPORT AND GATE-MOVEMENT UNITS

[75] Inventor: Michelangelo Manini, Bologna, Italy

[73] Assignee: FAAC S.p.A., Bologna, Italy

[21] Appl. No.: 399,138

[22] Filed: Mar. 6, 1995

[30] Foreign Application Priority Data

Mar. 22, 1994 [IT] Italy ..... MI940212 U

[51] Int. Cl.[6] ..... F01R 9/00; E05F 1/00

[52] U.S. Cl. ..... 92/136; 92/138; 16/71; 16/DIG. 7

[58] Field of Search ..... 92/136, 138, 85 B; 16/71, 79, 51, DIG. 7, DIG. 9, DIG. 21

[56] References Cited

U.S. PATENT DOCUMENTS

| | | | |
|---|---|---|---|
| 2,389,654 | 11/1945 | Werff | 92/136 |
| 3,477,177 | 11/1969 | Tucker, Jr. | 92/136 X |
| 3,605,409 | 9/1971 | Heese et al. | 92/136 X |
| 4,048,694 | 9/1977 | Newman et al. | 16/DIG. 21 X |
| 4,073,033 | 2/1978 | Lexnas | 16/DIG. 9 X |
| 4,502,180 | 3/1985 | Harrison et al. | 16/DIG. 9 X |
| 4,543,977 | 10/1988 | Arav | 92/85 B X |

FOREIGN PATENT DOCUMENTS

| | | | |
|---|---|---|---|
| 0255917 | 2/1988 | European Pat. Off. | 16/51 |

*Primary Examiner*—Hoang Nguyen

*Attorney, Agent, or Firm*—Shlesinger, Fitzsimmons & Shlesinger

[57] ABSTRACT

A hydraulic operating device for gate movement comprises a gate pintleing unit (10) comprising a box (11) with rotating support body (37) for a shaft (12) having a first gear (20) integral therewith projecting into the box. The shaft (12) faces at the top a box (11) with one of its axial fixing ends (15) integral with the gate rotation axis. The device also comprises a hydraulic operating unit made up of a drive element (25) consisting of a central body (32) from which project opposed hydraulic cylinders (26,27) in which run respective pistons (28,29). Between the pistons is connected a rack (30) traversing the central body (32) to project laterally therefrom with its teeth. It is thus possible to prepare a gate for future automation by mounting only the box and subsequently inserting therein the operating unit.

11 Claims, 4 Drawing Sheets

HYDRAULIC GATE MOVEMENT DEVICE COMPRISING SEPARATE SUPPORT AND GATE-MOVEMENT UNITS

BACKGROUND OF THE INVENTION

The present invention relates to a hydraulic unit for effecting gate movement.

In the known art are well known hydraulic devices for gate movement that buried at the foot of the gate to provide a motorised rotation pintle. Drives of this type are especially advantageous from the aesthetic viewpoint since the actuator remains completely hidden.

Especially if it is desired to add a motorised drive to a gate already installed or if a failed drive is to be replaced, the known devices are however a source of problems.

Indeed, since the gate pintle is supported directly by the drive, removal of installation of the drive involves disassembly of the gate. If the drive is installed, masonry is required.

To avoid inconvenience, with the pintle drives of the known art it is then necessary to determine at the time of installation of the gate if it is desired or not to motorise it.

The general purpose of the present invention is to overcome the above shortcomings by supplying a drive unit permitting predisposing a gate for rapid assembly at a later time of the actual drive, and also permitting easy removal and replacement of the drive without the need of removing the gate.

SUMMARY OF THE INVENTION

In view of said purpose it was sought to provide in accordance with the present invention a hydraulic drive device for gate movement comprising a pintleed unit for the gate and comprising a box with a supporting body rotating on a shaft having a first gear integral therewith protruding inside the box and the shaft facing at the top of the box with one of its axial fixing ends integral with the gate rotation axis and the device comprising in addition a hydraulic drive unit comprising a drive element comprising a central body from which project opposed hydraulic cylinders in which run respective pistons and there being connected between the pistons a rack traversing the central body to project laterally therefrom with its teeth and removable connection means permitting fixing of the drive unit inside the box for coupling of the rack teeth with the gear teeth.

BRIEF DESCRIPTION OF THE DRAWINGS

To clarify the explanation of the innovative principles of the present invention and its advantages compared with the known art there is described below with the aid of the annexed drawings a possible embodiment thereof by way of non-limiting example applying said principles. In the drawings.

DETAILED DESCRIPTION OF THE INVENTION

Figure 1:
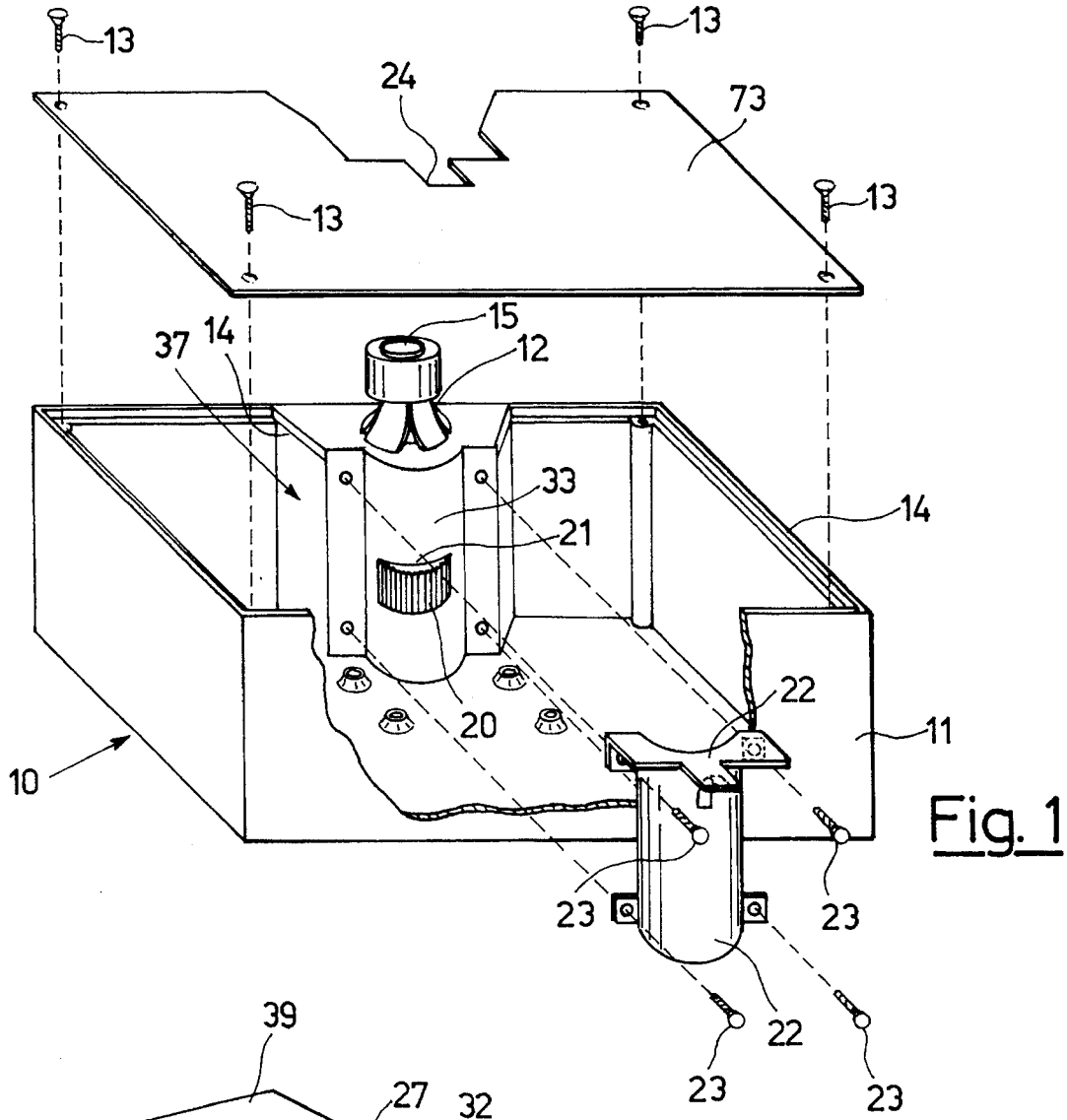
FIG. 1 shows schematically an exploded perspective view of a first part or pintle box of the movement unit in accordance with the present invention.

With reference to the figures, FIG. 1 shows schematically a box and pintle element or pivoting unit indicated generally by reference number 10 and made up of a casing or box 11 with cover 73 advantageously fixable in a sealed manner thereon, e.g. by means of screws 13 with interposition of a seal 14.

Figure 3:
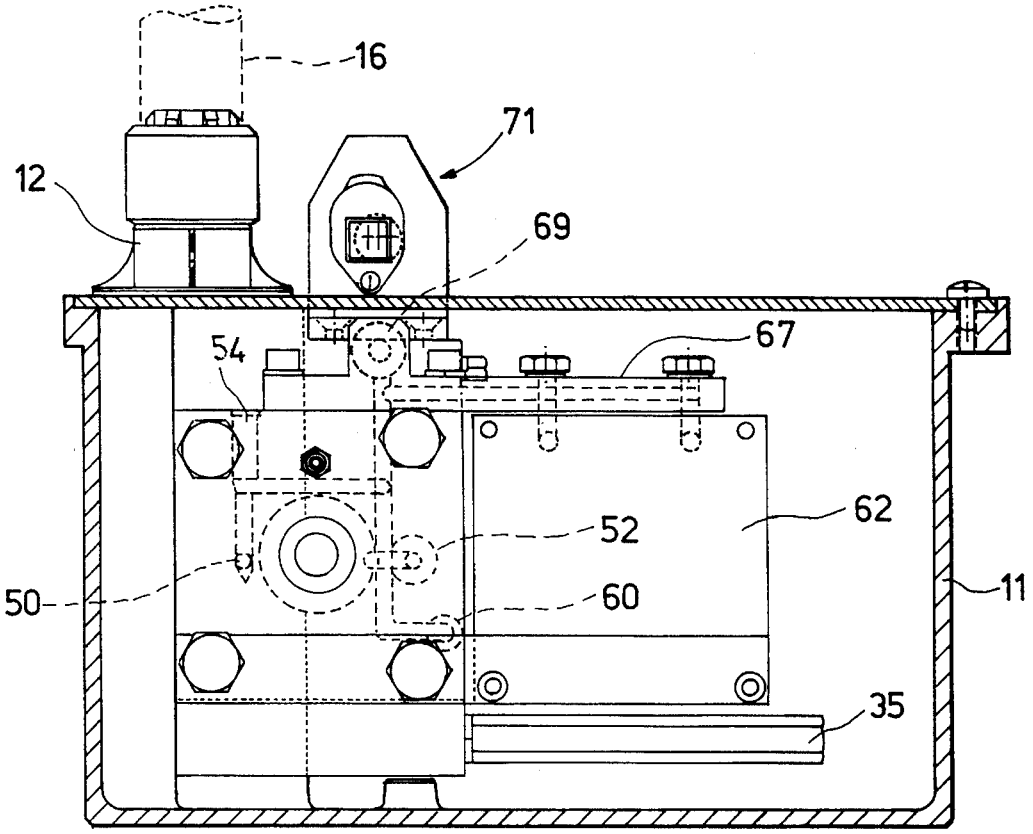
FIG. 3 shows schematically a cross section view along plane of cut III—III of FIG. 7.

The box element 10 comprises a vertical shaft 12 with upper end protruding above from the box to form a pintle seat 15 to which can be integrally connected the pintle of a known gate to be moved (as shown schematically by reference number 16 in FIG. 3).

Figure 4:
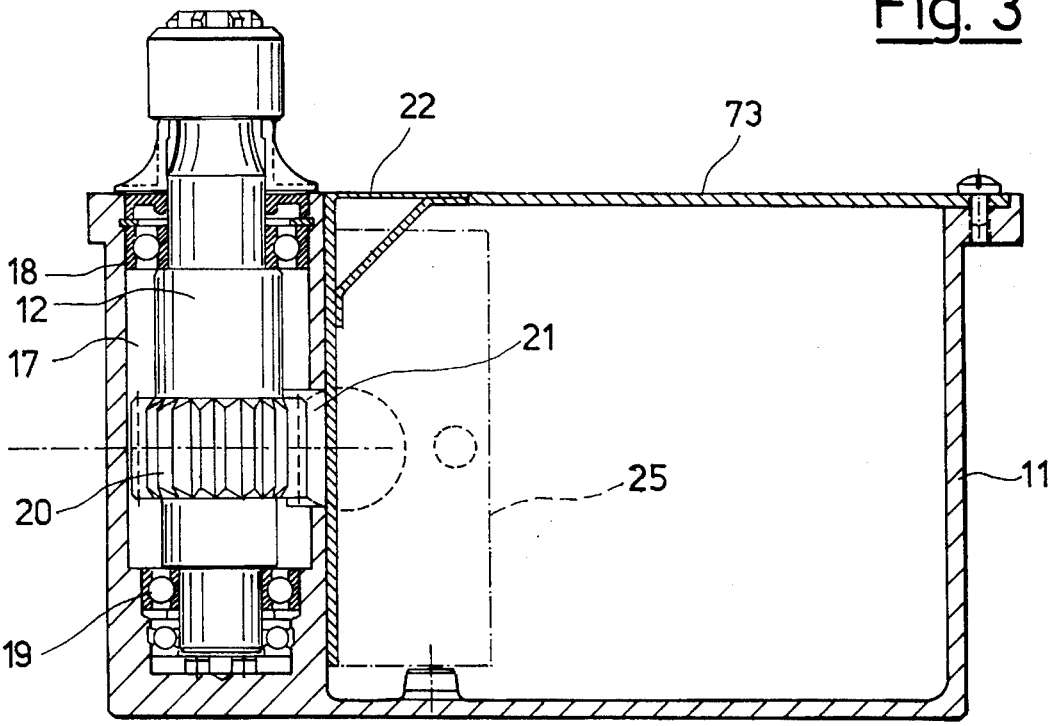
FIG. 4 shows schematically a cross section view along plane of cut IV—IV of FIG. 7 with some details removed.

As may be seen in FIG. 4 the shaft 12 is supported in a seat 17 in the box by means of bearings 18, 19. The seat 17 is made e.g. in a support block 37 protruding on the inner side of a peripheral wall of the box. The block can advantageously be made in a single piece from the box by casting.

In an intermediate position at the end the shaft supports in an integral manner a gear 20 protruding inside the box through an aperture 21 at the side of the seat 17 as may be seen well also in FIG. 1 opposite a semicylindrical wall 33.

The shaft 12 is free to rotate supported by the box body so as to provide a neutral pintle for the gate.

As may be seen in FIG. 1 the aperture 21 is advantageously coverable by means of a mask 22 fixable in place by means of screws 23. The mask 22 has an upper part for closure of a passage 24 present in the cover 73 for reasons clarified below.

Figure 2:
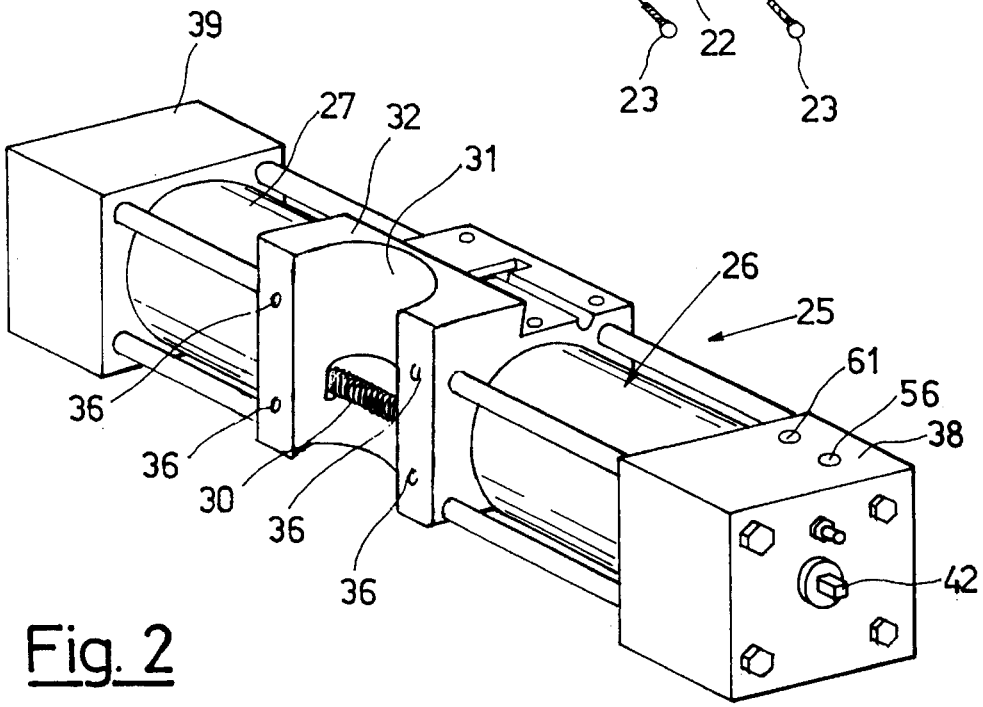
FIG. 2 shows schematically a perspective view of a drive element for the movement unit in accordance with the present invention.

FIG. 2 shows an actuator element indicated generally by reference number 25 and insertable in the box 10. As may be seen in FIG. 5 the actuator 25 is made up of a pair of opposed hydraulic pistons 26, 27 whose respective pistons 28, 29 are mechanically connected to the two ends of a rack rod 30. The rack runs centrally in a connecting body 32 between the two pistons 26, 27. The body 32 has a semicylindrical recess 31 complementary to the semicylindrical wall 33 having an axis transversal to the rod extension. The recess 31 has an aperture 34 from which protrude the rack teeth.

Figure 7:
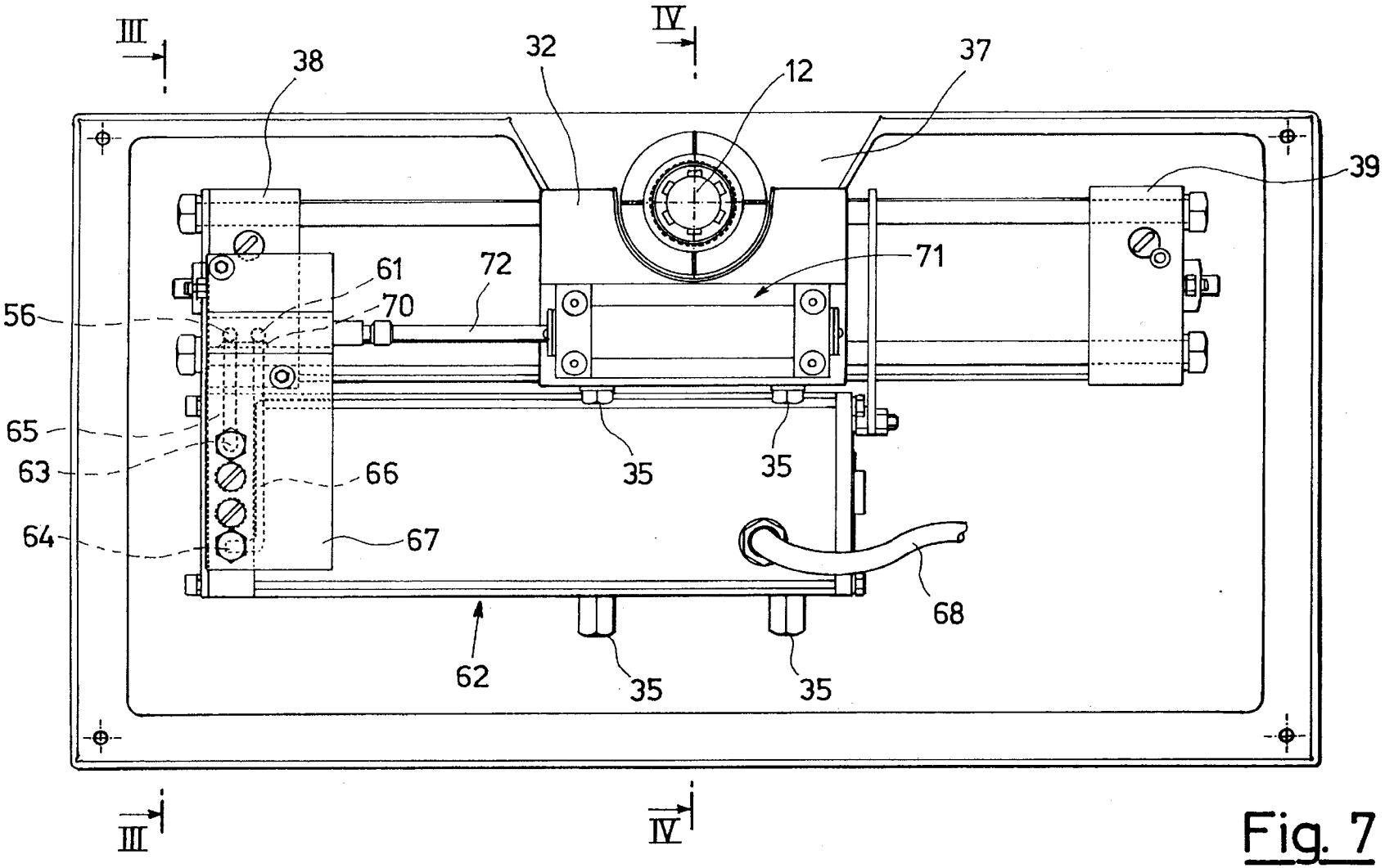
FIG. 7 shows schematically a plan view of the movement unit in accordance with the present invention.

As may be seen in FIGS. 3 and 7 and in broken lines in FIG. 4 the hydraulic actuator element 25 is positionable in the box to be fixed after removal of the mask 22 with removable fixing means so that the recess 31 receives the complementary semicylindrical wall 33 so as to mesh the gear 20 with the rack.

Movement of the rack thus rotates the shaft 12 to move the gate integral therewith. The actuator element can be e.g. fixed by means of four screws passing through the body 32 to screw into the threaded holes prepared in the box on a flat wall at the two sides of the semicylindrical surface for fixing also the screws 23 of the mask. In FIG. 7 are seen the heads 35 of the four drive fixing screws while in FIG. 2 are seen clearly the holes 36 for passage of the screws into the body 32.

With the solution in accordance with the present invention it is possible to bury or fix in a known manner the box 10 at the base of the gate with the shaft 12 acting as the gate pintle.

If automatic movement of the gate is not desired immediately it is possible to position the mask 22 so as to close the aperture in the box. The gate will thus be supported by the box and hinged in a neutral manner thanks to a normal upper pintle and to the lower pintle consisting of the box.

It is possible at any time to motorise the gate merely by opening the box, removing the mask 22 and positioning the movement unit comprising the actuator element in the seat provided with a simple screw fastening. Thanks to the provision of two independent units, i.e. the pintle box and the actuator unit, the installation operation is fast and does not necessitate even disassembly of the gate and does not require special skills from the installer. Returning to FIG. 5 there is shown a particularly advantageous embodiment of the actuator element. As may be seen in said figure the heads 38, 39 each of the respective opposed pistons 26, 27 receives a rotating element 40, 41 each having its own axial tang 42, 43 protruding outside for manual rotation. Each rotating element 40, 41 has a sleeve 44, 45 screwed thereon to protrude inward of the respective cylinder chamber and constitute an extension of an axial duct 46, 47 in the respective rotating element. As may be seen clearly for the sleeve 44 each piston 28, 29 has a front seat 48, 49 to receive in a sealed manner the free end of the respective sleeve protruding in the cylinder.

Each head 38, 39 also has a respective duct 50, 51 opening freely into the respective chamber of the cylinder and a one-way valve 52, 53 opening toward its respective cylinder chamber.

Figure 5:
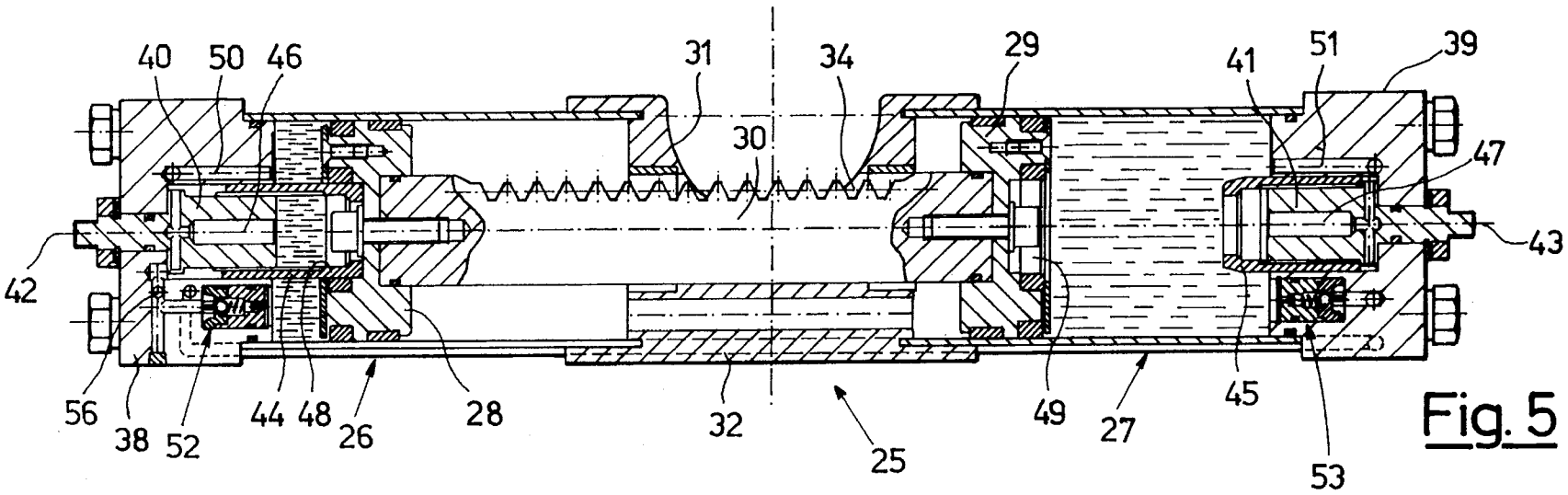
FIG. 5 shows schematically a plan view partially sectioned longitudinally of the operating element of FIG. 2.
Figure 6:
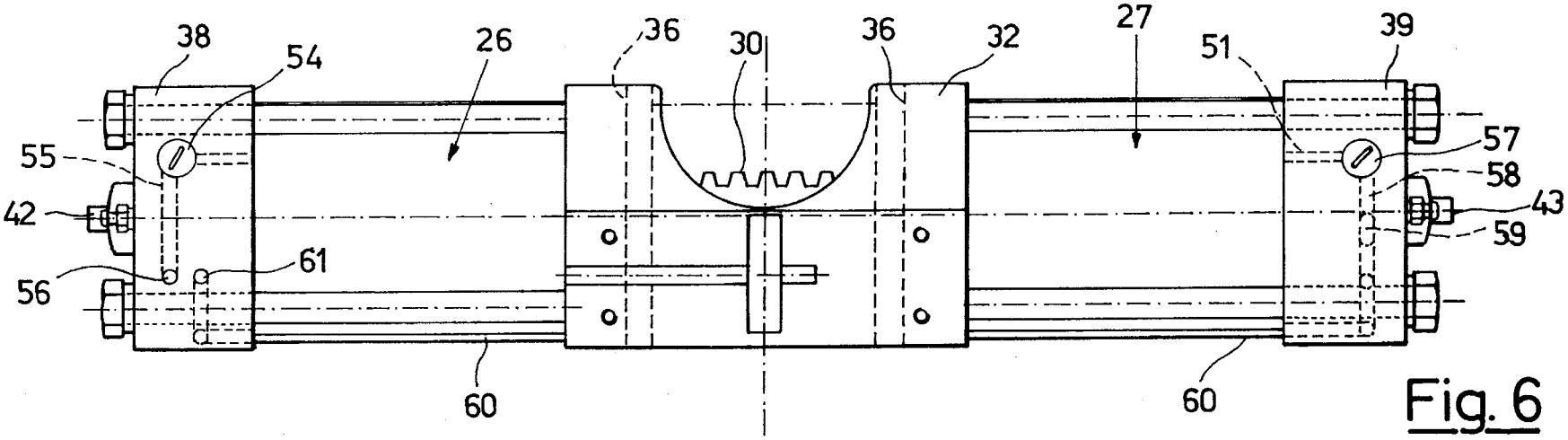
FIG. 6 shows schematically a plan view of the operating element of FIG. 2.

As may be seen from comparison of the FIGS. 3, 5 and 6 the duct 50 is connected through valve 54 with adjustable opening and a duct 55 to an outlet duct 56 on the surface of the head 38. As may be seen in FIG. 5 to said outlet 56 is also connected the one-way valve 52 and the duct 46. Similarly the duct 51 is connected through an adjustable passage valve 57 to a duct 58 to which is also connected the duct 47 through a passage 59 connected to the chamber, in which rotates the element 41, and the one-way valve 53. The duct 58 is in turn connected to an external duct 60 arranged between the two heads 38, 39 to connect the duct 58 to an outlet duct 61 arranged near the outlet 56. The first outlet 56 and the second duct 61 are the inlet/outlet passages for the actuator control fluid and are to be connected to the delivery/suction passages of a drive pump. Advantageously as may be see in FIGS. 3 and 7 to the hydraulic actuator element 25 can be directly connected a reversible electric pump 62 of the known art and therefore not shown in detail and having an electrical connection 68 for supply of the pump motor and first and second suction/delivery unions 63, 64 connected to the outlets 56 and 61 of the actuator by means of respective ducts 65, 66 made in an interconnection plate 67 fixed between the actuator element 25 and the pump 62. The pump and actuator thus form a single assembly insertable rapidly in the box and needing only the electrical connection 68 to operate.

Advantageously the two outlets 56, 61 can be interconnected by means of a connecting tap so as to be able to neutralise the actuator movement if manual movement of the gate is necessary. As may be seen in FIGS. 3 and 7 the interconnection valve is provided e.g. by means of a cylindrical insert 69 inserted in an appropriate seat of the plate 67. The insert has a peripheral groove 70 arranged in such a manner as to bring into communication the two ducts 56 and 61 when it is rotated in a predetermined position. Rotation of the insert or tap 69 is achieved by means of a key mechanism 71 connected to the insert 69 by means of a transmission 72 and protruding from the box through the passage 24 in the cover 73. The key mechanism—of the known art and therefore not further shown nor described—can be operated from the outside of the movement unit so as rotate the insert 69 and neutralise the gate movement. This is useful to be able to move the gate in case of operation failure.

There is now described operation of the actuator in accordance with the present invention.

It is assumed that the actuator is in the position shown in FIG. 5, i.e. with the rack in its far left position. The pump is controlled to supply fluid to the union 56 and take it at the union 61.

The pressurised fluid thus enters the cylinder 26 through the passages 46, 50 and 52 and pushes the piston 28 to the right.

Although the passage 50 is throttled by the valve 54 the fluid can pass freely in the cylinder through the one-way valve 46. This causes traversing to the right of the rack and the other piston 29. The fluid in the cylinder 27 is pushed through the passages 41 and 51 while the one-way valve 53 remains closed. Although the passage 51 is throttled by the valve 57 the passage 47 has a cross section sufficiently large for free flow of the fluid which thus reaches the outlet union 61 and then the pump suction.

The rightward movement of the rack and hence rotation of the coupled shaft 12 and the gate integral therewith continues at maximum speed until the free end of the sleeve 45 is received in a sealed manner in the seat 49. At this point the fluid, in the cylinder 27 can no longer flow out through the passage 47 and therefore passes only through the throttled passage 51 of the valve 57. This produces a hydraulic shock absorbing effect which brakes movement of the actuator until the end of the sleeve 45 reaches the bottom of the seat 49 when the pump turns off, e.g. by means of an overpressure sensor therein or another limit detecting device or a timing device.

At this point the actuator is ready for a return stroke and hence reverse movement of the gate actuated by reversal of the motion of the pump so that the fluid is pushed into the cylinder 27 and sucked by the cylinder 26 in a manner similar to that seen above for the outbound stroke until the piston 28 stops at the limit with shock absorbing effect provided by entry of the sleeve 44 in the seat 48.

The limit positions at the two piston stroke ends can be adjusted by rotating the tangs 42, 43 so as to advance or retract the sleeves 44, 45 in their respective chambers. At this point it is clear that the set purposes have been achieved by supplying a movement device easy to employ and flexible in use thanks to the fact that it is made up of separate units for support and movement of the gate. Naturally the above description of an embodiment applying the innovative principles of the present invention is given merely by way of example and therefore is not to be taken as a limitation of the patent right claimed here. For example, the proportions of the various parts constituting the device can be modified depending on the particular practical application. The connection insert between the outlets of the two cylinders can also be the slide valve instead of rotary type. In addition, the pump can be connected to known control systems, e.g. comprising photoelectric cells for control of gate opening and closing, remote operation controls, etc. The pump unit can also be separated from the actuator. Lastly, the valves 54, 57 can be of a known pin type or equivalent or the pressure sensitive type like one-way valves with spring-loaded ball.

What is claimed is:

1. A hydraulic operating device for effecting movement of a gate, comprising a pintle unit for the axle of a gate and comprising a box with a support body for rotatably supporting a shaft having a first gear integral therewith and protruding into the box, and the shaft extending above the box at one of its axial ends and being fixed integral with the lower end of the gate rotation axle, and the device comprising in addition a separate hydraulic operating unit comprising a drive element having a central body from which project opposed hydraulic cylinders in which run respective pistons, and between the pistons there being connected a race traversing the central body to have the teeth thereof protrude laterally therefrom, and removable connection means permitting fixing of the operating unit removably inside the box optionally to mesh the teeth of the rack with the teeth of the gear, and thus removably to couple the pintle unit to the operating unit.

2. A device in accordance with claim 1 characterised in that the operating unit comprises a pump for movement of fluid between the two cylinders of the drive element.

3. A hydraulic operating device for effecting movement of a gate, comprising a pintle unit for the axle of a gate and comprising a box with a support body for rotatably supporting a shaft having a first gear integral therewith and protruding into the box, and said shaft extending above the box at one of its axial ends and being fixed with the gate rotation axle, and the device comprising in addition a hydraulic operating unit comprising a drive element having a central body from which project opposed hydraulic cylinders in which run respective pistons, and between said pistons there being connected a rack traversing said central body to have the teeth thereof protrude laterally from said body and removable connection means permitting fixing of the operating unit removably inside the box to mesh the teeth of the rack with the teeth of the gear, and thus removably to couple the pintle unit to the operating unit, and wherein the gear teeth protrude into the box opposite a passage in a first semicylindrical wall of the box, and with axis of the wall being parallel to the shaft, and the central body of the drive element has therein a recess having thereon a second semicylindrical surface from which project the rack teeth and designed for complementary reception of the first semicylindrical wall upon coupling between the pintle unit and the operating unit.

4. A hydraulic operating device for effecting movement of a gate, comprising a pintle unit for the axle of a gate and comprising a box with a support body for rotatably supporting a shaft having a first gear integral therewith and protruding into the box, and said shaft extending above the box at one of its axial ends and being fixed with the gate rotation axle, and the device comprising in addition a hydraulic operating unit comprising a drive element having a central body from which project opposed hydraulic cylinders in which run respective pistons, and between said pistons there being connected a rack traversing said central body to have the teeth thereof protrude laterally from said body, and removable connection means permitting fixing of the operating unit removably inside the box to mesh the teeth of the rack with the teeth of the gear, and thus removably to couple the pintle unit to the operating unit, and wherein each cylinder comprises a passage for supply and drain of fluid which is connected inside the cylinder chamber near the head of the cylinder opposite the other cylinder and through a first duct comprising an adjustable passage valve and a second duct comprising a one-way valve for passage of fluid toward the chamber and a third duet comprising a sleeve axial with the cylinder and projecting with a free end into the chamber to be received in a sealed manner in a compleentary seat in the cylinder piston when the cylinder piston is in its position near said head and thus supply a cushioned limit.

5. A device in accordance with claim 4 characterised in that the sleeve has axial movement adjustable from the outside of the cylinder to set the point of the piston stroke at which the sleeve enters said sealed seat on the piston and provide a mechanical limit striker.

6. A device in accordance with claim 4 characterised in that the first, second and third passages are made in the cylinder head and the supply and drain passages of both the cylinders have outlets opposite a lateral surface of only one head and on said lateral surface there being fixed a plate with interconnection passages between the two outlets and the fluid movement pump.

7. A device in accordance with claim 6 characterised in that the plate comprises a moving insert for direct connection between the two outlets.

8. A device in accordance with claim 7 characterised in that the moving insert is driven between a disconnected position and a connected position of the outlets by means of a lock mechanism projecting from the box.

9. A device in accordance with claim 8 characterised in that the lock mechanism projects from the box through a passage made in a closing cover of the box.

10. A device in accordance with claim 3 and characterised in that it comprises a closing mask for the passage in the cover and of the passage in the first semicylindrical wall when the operating unit is removed from the box.

11. A device in accordance with claim 8 characterised in that the box and the body supporting the shaft are made in one piece.

* * * * *